US005324021A

United States Patent [19]

Onomoto et al.

[11] Patent Number: 5,324,021

[45] Date of Patent: Jun. 28, 1994

[54] FUZZY CONTROL DEVICE TO FEED AND ADJUST SHEETS OF PAPER

[75] Inventors: Ryuichi Onomoto, Kusatsu; Masaji Ishida, Otsu, both of Japan

[73] Assignee: Omron Corporation, Kyoto, Japan

[21] Appl. No.: 762,451

[22] Filed: Sep. 19, 1991

[30] Foreign Application Priority Data

Sep. 19, 1990 [JP] Japan ..... 2-251221

[51] Int. Cl.[5] ..... B65H 7/02

[52] U.S. Cl. ..... 271/227

[58] Field of Search ..... 271/227, 228; 395/3

[56] References Cited

U.S. PATENT DOCUMENTS 4,944,505 7/1990 Sherman, III .
4,971,304 11/1990 Lofthus ..... 271/227
4,976,377 12/1990 Higuchi et al. ..... 222/55
5,078,384 1/1992 Moore ..... 271/227
5,094,442 3/1992 Kamprath et al. ..... 271/227
5,104,109 4/1992 Kubo ..... 271/3.1

FOREIGN PATENT DOCUMENTS 180635 7/1988 Japan ..... 271/227
317938 12/1989 Japan ..... 271/227

OTHER PUBLICATIONS

Patent Abstracts of Japan, vol. 14, No. 295, 26 Jun. 1990.

*Primary Examiner*—Robert P. Olszewski
*Assistant Examiner*—Steven M. Reiss
*Attorney, Agent, or Firm*—Dickstein, Shapiro & Morin

[57] ABSTRACT

A fuzzy logic control device is used in conjunction with a pair of coaxially aligned and independently controlled paper feed rollers and a paper skew detector to detect and correct skew in a conveyed paper in a paper feeding device.

4 Claims, 6 Drawing Sheets

MEMBERSHIP FUNCTIONS CORRESPONDING TO VALUE OF ROTATIONAL OUTPUT OF LEFT PULSE MOTOR

MEMBERSHIP FUNCTIONS CORRESPONDING TO VALUE OF ROTATIONAL OUTPUT OF RIGHT PULSE MOTOR

FUZZY CONTROL DEVICE TO FEED AND ADJUST SHEETS OF PAPER

BACKGROUND OF THE INVENTION

This invention relates to a device for feeding sheets of paper such as may be found inside an automatic teller or other machine which handles bank notes. In particular, it relates to a fuzzy logic control device which can correct the rate of feed as the paper is being fed. Generally, this type of paper feed device feeds a single sheet of paper by means of a feed roller located in the feed portion of the paper container.

Bank notes in circulation are subject to certain problems. Bills may be wrinkled or weakened, or they may have tape, glue, or other foreign matter stuck to them. Frictional resistance may cause a bill to move in an irregular fashion at the moment it separates from a stack. Thus skew may occur in the initial stage of paper feed. This skew is generally detected by a sensor, after which the bill is rectified or removed. However, the machine is jammed from the time the skew occurs until the problem is solved.

SUMMARY OF THE INVENTION

One object of this invention is to provide a fuzzy logic control device which can adjust the paper in a paper feed process. The adjustment is performed by checking the alignment of the paper being fed and correcting that alignment so as to achieve a normal feed alignment.

The invention employs a fuzzy logic control device to correct the alignment of sheets of paper being fed, which comprises a pair of coaxially mounted independently driven rollers which feed single sheets of paper, which rollers are driven independently, to control the rate at which a sheet of paper is fed from a container; means for detecting when a sheet of paper which has been fed from the container is askew; and, means for performing a fuzzy inference using data from the detecting means in order to determine the appropriate rate at which the independently driven rollers should feed a sheet of paper, an output of the performing means being used to sepapately control the speed of rotation of the rollers to eliminate skew. The fuzzy inference is based on fuzzy rules formulated from data collected under various conditions and expressed as fuzzy variables. The fuzzy rules are designed to convert the feed rate of a skewed sheet of paper to a rate that will straighten it under various conditions of skew.

Each time a sheet of paper is fed, the detectors ascertain the alignment of the paper. The control device uses this detected alignment as a starting point and outputs the amount of correction of the feed rate which is required to achieve an appropriate feed rate of the rollers to correct the skew as the skewed paper is being fed by the rollers. This amount of correction is based on fuzzy rules from which the optimal paper alignment is inferred as a consequent. The output data are used to adjust the feed rates of the two independent feed rollers, positioned side by side, to their appropriate values.

Since sheets of paper often behave in an unstable fashion their handling by paper feed devices is difficult. This invention detects a tendency to skew in the initial stage of the feed process, and the alignment of the paper can be rectified immediately. Thus the invention provides a highly stable and reliable feed process from which the threat of an obstruction in the later feed stages has been removed.

The above and other objects, advantages and features of the invention and others will be more readily understood from the following detailed description of the invention which is provided in connection with the accompanying drawings.

BRIEF DESCRIPTION OF THE DRAWINGS

The drawings illustrate one embodiment of this invention.

FIG. 5 (*b*) is a graph showing the membership functions corresponding to the outputs in r.p.m. of the right pulse motor;

DETAILED DESCRIPTION OF THE INVENTION

Figure 1:
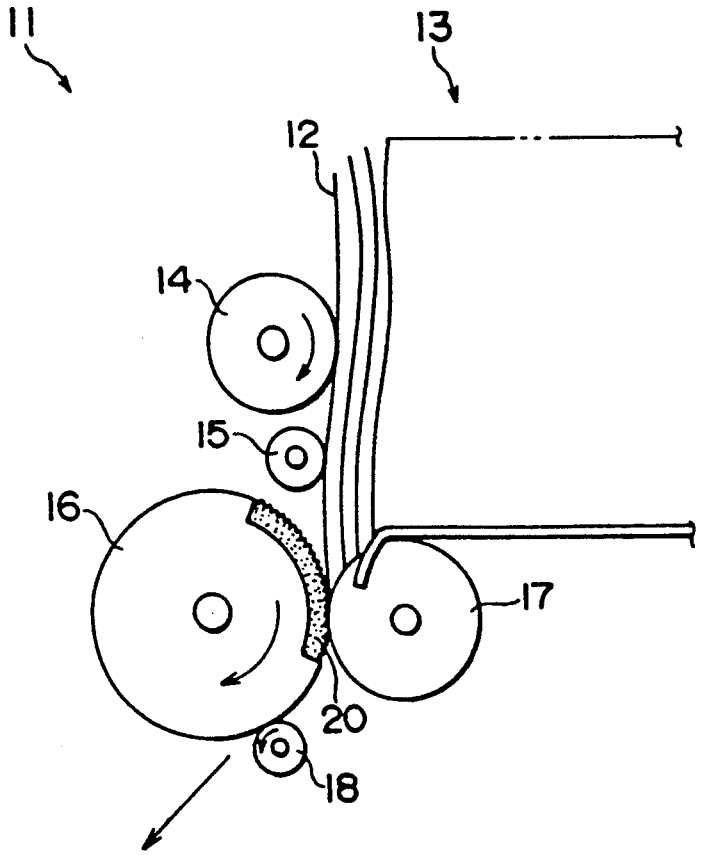
FIG. 1 is a side view of the components of a bill feed mechanism.
Figure 2:
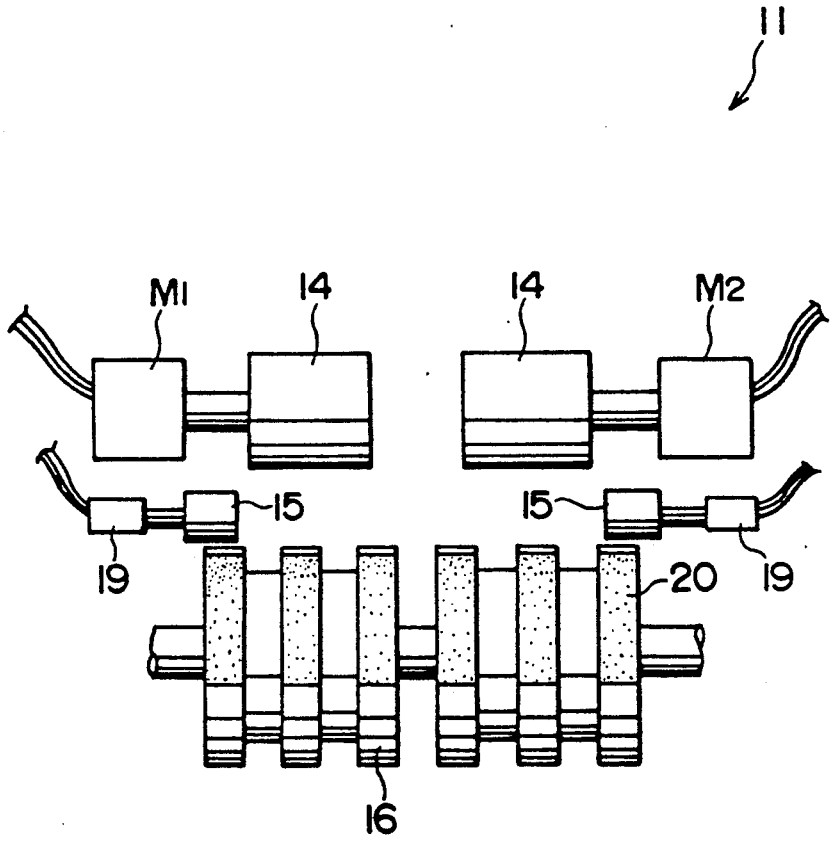
FIG. 2 is a front view of these same components.

The drawings illustrate a fuzzy control device to ad just paper feed which is installed in a feed mechanism for bank notes. In FIGS. 1 and 2, a bill feed mechanism 11, which might be contained in a cartridge, is provided in the feed path on the front surface of bill container 13, which permits bill 12 to be received in vertical position. On the upper portion of the feed path are left and right coaxial pickup rollers 14 and their corresponding feed rate detector rollers 15. On the lower portion of the feed path is feed roller 16, next to which is mounted gate roller 17, which regulates the feed of each individual bill. At the end of the feed path, support roller 18 presses against bill 12 and conveys it out of the feed path. Thus all these rollers 14 through 18 serve to feed bills one at a time through the feed mechanism.

The pickup rollers 14 are caused to rotate independently by pulse motors M1 and M2. Small left and right detector rollers 15 make contact with bill 12 as it is being fed and rotate at a speed which corresponds to the speed at which the bill is delivered, which is based on the rotational speed of pickup rollers 14. The rotational speeds of detecting rollers 15 are calculated by tachometers 19, and in this way any skew which has occurred in the initial stage of the feed process is detected.

Feed roller 16 and gate roller 17, which are positioned on the feed path, are fashioned into meshing tooth patterns to facilitate separation. Feed roller 16 is of a sufficiently large diameter that it feeds one bill 12 with each revolution. A portion of its rotational surface is covered with feeder member 20, which consists of rubber or some other material with a high frictional coefficient.

Gate roller 17 has a built-in one way clutch to ensure that it rotates only in the direction of feed. This clutch allows the gate roller to have the function of feeding a single bill at a time. The combination of the rollers executes the feed operation for a single bill 12. These rollers cause a bill which has been sent to pass between feed roller 16 and support roller 18 in the final stage of the feed process and to be conveyed in a specified direction.

Figure 3:
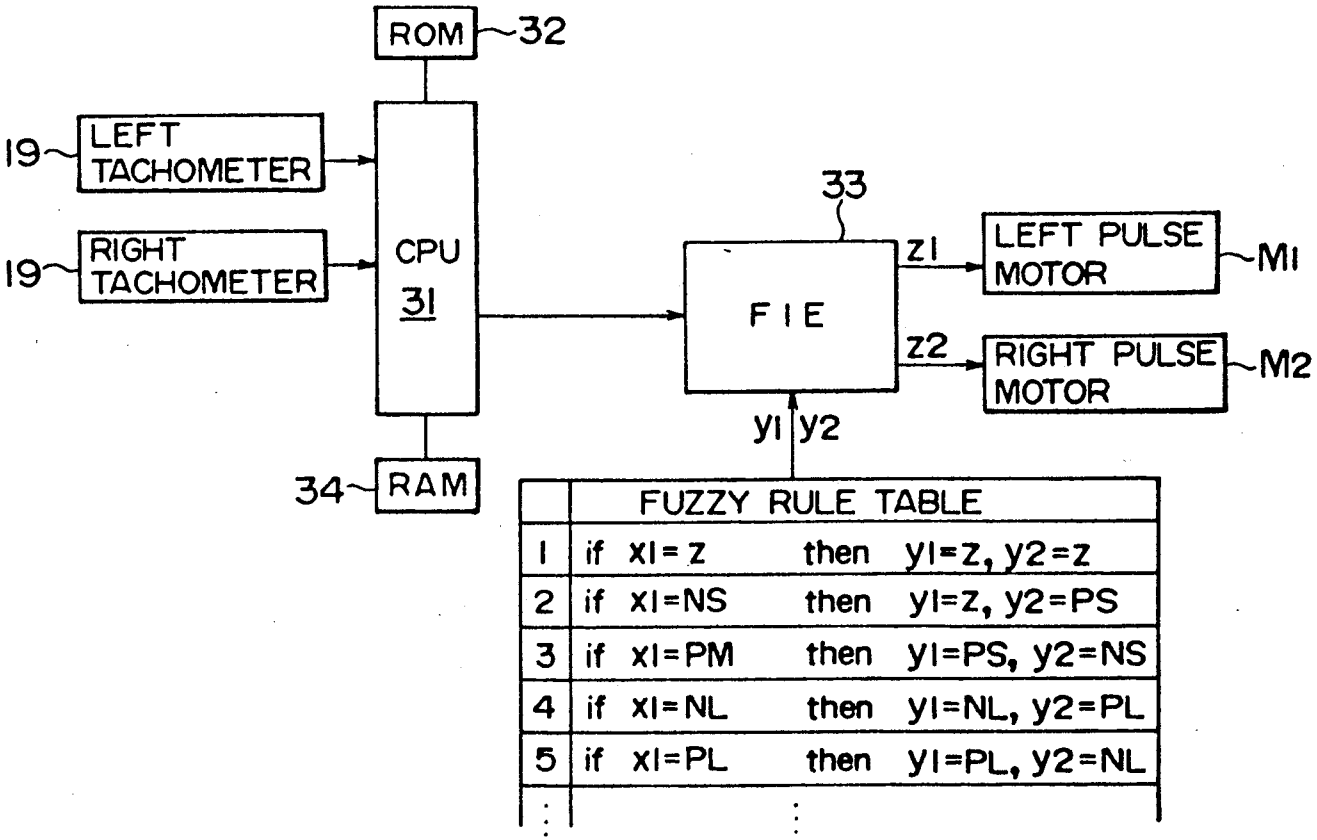
FIG. 3 is a block diagram of the control circuit which performs fuzzy inferences to correct the bill feed.

FIG. 3 is a block diagram of the control circuit which performs a fuzzy logic inference to correct the feed of the bill. CPU 31 uses the detection signal obtained from tachometers 19 through left and right detection rollers 15 and a program stored in ROM 32 to output the appropriate amount of speed correction to left and right pulse motors M1 and M2 by way of fuzzy inference engine (hereafter "FIE") 33. The control data needed at this time are stored in RAM 34.

The FIE 33 chooses a fuzzy rule which takes as its antecedent X1 (premise) the currently detected data supplied by CPU 31 and obtained by means of the detection signals from left and right tachometers 19. The values Y1 and Y2, which are inferred using the rule, determine the feed rates for bill 12, which are thus set in response to the currently detected data. Based on the fuzzy rule applied to the aforementioned detected data, the appropriate amounts of speed correction (motor r.p.m.) are output as Z1 and Z2. Pulse motors M1 and M2 are driven in the initial stage of feed according to the amounts Z1 and Z2 which have been output. The feed rate of bill 12 is corrected to produce a flawless feed. In this way fuzzy logic inference is used to control the feed process.

The fuzzy rule is chosen in accordance with fuzzy rule table 35, which has been assembled previously. The appropriate limit value for the angle of skew of bill 12 in the initial stage of feed has been established previously. This appropriate value is compared with the actual detected value, and the appropriate conclusion is established, with regard to these facts, by means of the membership functions dependent on the fuzzy variables shown in FIGS. 4 (premises), and 5*a* and 5*b* (consequent).

In these membership functions, the labels (fuzzy variable values) indicating the extent of fuzzy convergence (grade) are assigned according to the combination of a group indicating direction, i.e., negative (N), standard (Z), or positive (P); and a group indicating degree, i.e., large (L), medium (M), or small (S).

Figure 4:
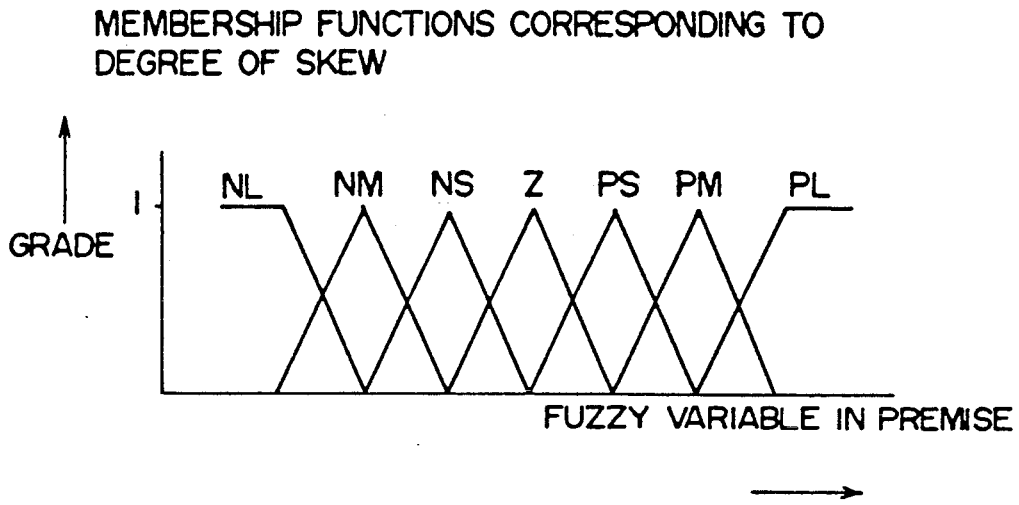
FIG. 4 is a graph showing the membership functions corresponding to degree of skew.
Figure 5A:
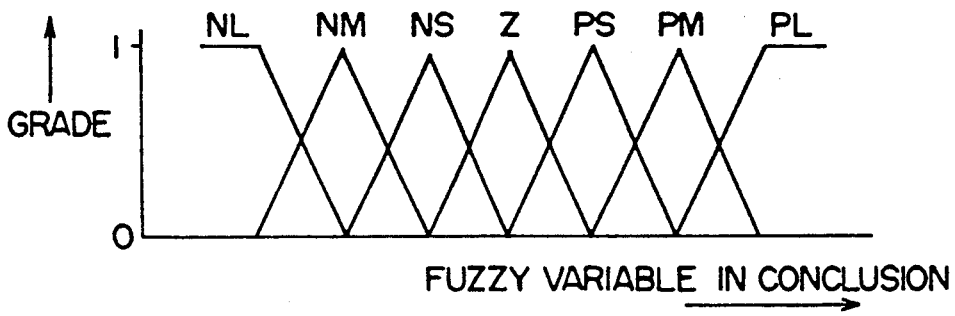
FIG. 5 (*a*) is a graph showing the membership functions corresponding to the outputs in r.p.m. of the left pulse motor.
Figure 5B:
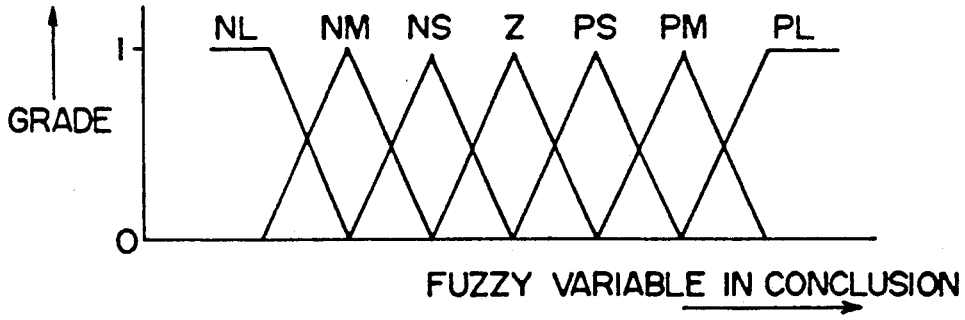

The membership functions represent the degree of skew X1 obtained from the difference in r.p.m. between left and right detection rollers 15 shown in FIG. 4. They are:

NL: Considerable skew to the left
NM: Some degree of skew to the left
NS: Slight skew to the left
Z: No skew
PS: Slight skew to the right
PM: Some degree of skew to the right
PL: Considerable skew to the right The membership functions in FIG. 5*a*, which correspond to Y1, the output (in r.p.m.) of the left pulse motor, are:

NL: Reduce speed of rotation substantially
NM: Reduce speed of rotation moderately
NS: Reduce speed of rotation slightly
Z: Maintain standard Speed of rotation
PS: Increase speed of rotation slightly
PM: Increase speed of rotation moderately
PL: Increase speed of rotation substantially The membership functions in FIG. 5*b*, which correspond to Y2, the output (in r.p.m.) of the right pulse motor, are:

NL: Reduce speed of rotation substantially
NM: Reduce speed of rotation moderately
NS: Reduce speed of rotation slightly
Z: Maintain standard Speed of rotation
PS: Increase speed of rotation slightly
PM: Increase speed of rotation moderately As an example of how the fuzzy rule table 35 might be formed the rules which appear in FIG. 3 are as follows.

Rule 1

If the bill is not skewed at all in the initial stage of feed (X1=Z), the detectors register a proper initial feed. FIE 33 maintains the r.p.m. of pulse motors M1 and M2 (Y1=Z) (Y2=Z), and left and right pickup rollers are driven at the same rotational speed.

If X1=Z
Then Y1=Z and Y2=Z

In this case, since bill 12 is being fed properly in the initial stage, no skew will occur in either direction during the time it takes the bill to achieve the specified speed of feed V. Left and right tachometers 19 will indicate that the bill is being conveyed in a stable fashion such that there is no difference $A_0$ between the r.p.m. of the two detector rollers.

Rule 2

If the detectors find that the right side of the bill is thrust forward so that there is a moderate skew to the right (X1=PM), FIE 33 will slightly increase the r.p.m. of left pulse motor M1 (Y1=PS) so as to slightly raise the rotational speed of left pickup roller 14. At the same motor M2 (Y2=NS) so as to slightly decrease the rotational speed of right pickup roller 14. In this way the initial skew of bill 12 will be immediately corrected.

If X1=PM
Then Y1=PS and Y2=NS

Figure 6A:
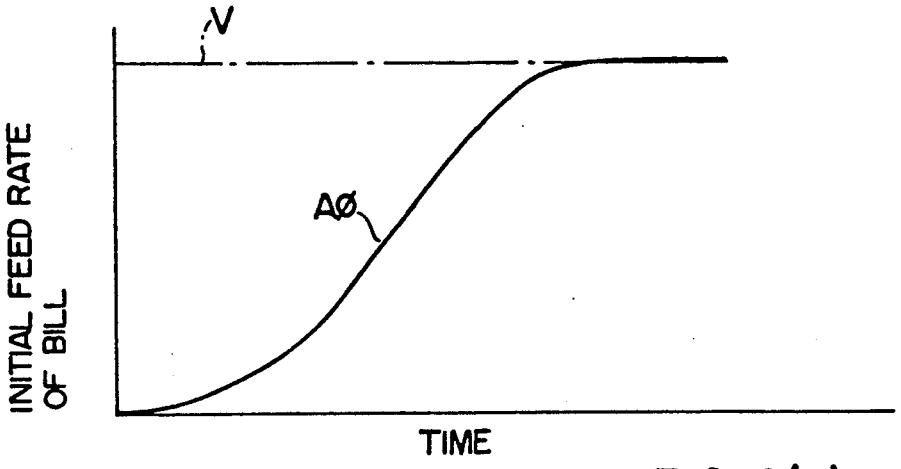
FIGS. 6 (*a*) through (*c*) are graphs showing the relationship between the speed at which the bill is conveyed during the initial stage of feed and the acceleration time.
Figure 6B:
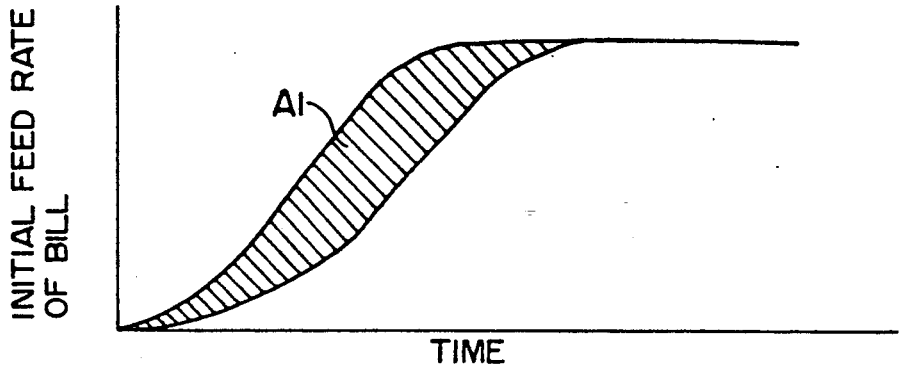

Thus if bill 12 becomes skewed in the initial stage of feed, the skew will be detected clearly from the difference in r.p.m. between the two detector rollers which is registered by left and right tachometers 19, as shown in FIG. 6*b*. The severity of skew $A_1$, which correlates with the disparity between the r.p.m. of the two detector rollers, is shown by the area filled in with slanted lines.

Figure 6C:
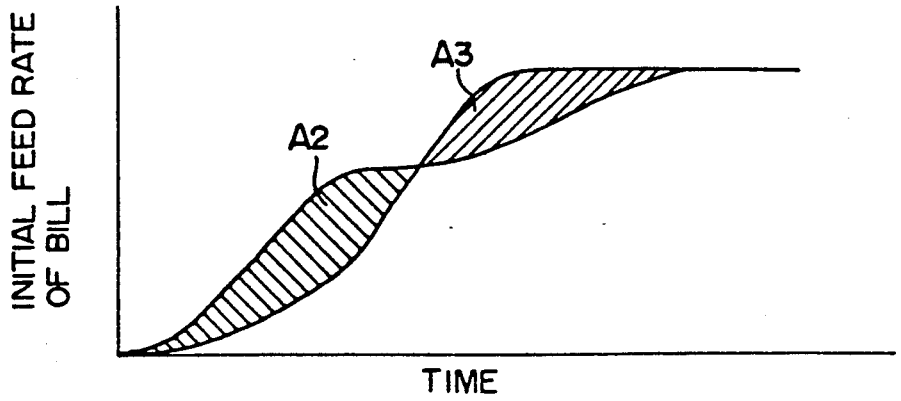

To eliminate this skew promptly, degree of correction $A_3$ is output in response to the degree of skew $A_2$ detected during the initial stage of feed, as shown in FIG. 6*c*. Thus the feed is corrected in the initial stage so that the bill is conveyed in a stable fashion without skew.

Rule 3

If the detectors find that the left side of the bill is thrust forward a bit, and there is a slight skew to the left (X1=NS), FIE 33 will maintain the left pulse motor at the same r.p.m. (Y1=Z), and will slightly increase the r.p.m. of the right pulse motor (Y2=PS). The rotational speed of right pickup roller 14 will increase, and the initial skew of bill 12 will be promptly corrected.

If X1=NS
Then Y1=Z and Y2=PS

As can be seen in Rules 1 through 3, proper conditions of feed for bill 12 are obtained by invoking a rule corresponding to the conclusion prefaced by "then" in response to the input of the premise prefaced by "if."

As has been discussed above, bank notes often behave in an unstable fashion which may cause difficulties for paper feed devices. The conditions under which feed is attempted can also be unstable. With this invention, a tendency to skew can be detected in the initial stage of the feed process, and the alignment of the paper can be rectified immediately. Thus the invention enables us to realize a highly stable and reliable feed process from which the threat of a skew has been eliminated before it can cause problems.

While an embodiment of the invention has been described and illustrated, it should be apparent that many modifications can be made without departing from the spirit or scope of the invention. Accordingly, the invention is not to be taken as limited to the description or drawings but is only limited by the scope of the appended claims.

We claim:

1. A fuzzy logic paper feeding mechanism comprising:

feeding means for feeding single sheets of paper from a paper source, said feeding means controlling the rate of feed of paper from said paper source and comprising:

a pair of rollers; and means for independently driving said rollers;

detecting means for detecting when a paper being fed by said feeding means is askew, said detecting means comprising a pair of detectors, for respectively detecting the rate of feed of paper by each of said rollers;

fuzzy inference performing means responsive to outputs of said pair of detectors for providing at least one control signal to said feeding means to cause said driving means to straighten a skewed paper being fed by said feeding means, said inference performing means including a fuzzy logic device which performs a fuzzy inference on data contained in the outputs of said pair of detectors.

2. A mechanism as in claim 1, further comprising processing means coupled to said detectors for providing data relating to the feed rate of said paper by each of said rollers, said performing means comprising a fuzzy inference engine which in response to said data determines a fuzzy inference rule to use in generating said control signals.

3. A mechanism as in claim 2, wherein a plurality of fuzzy inference rules are prestored in a memory and said fuzzy inference engine accesses said rules in said memory.

4. A mechanism as in claim 1, wherein said rollers are coaxially mounted.

* * * * *